US008927482B1

(12) United States Patent
Patterson

(10) Patent No.: US 8,927,482 B1
(45) Date of Patent: Jan. 6, 2015

(54) SURFACE CLEANING COMPOSTION OF COLLOIDAL ALKALI CARBONATES SUSPENDED IN FATTY ACIDS

(71) Applicant: Rudolph Albert Patterson, San Bernardion, CA (US)

(72) Inventor: Rudolph Albert Patterson, San Bernardion, CA (US)

(73) Assignee: Rudolph Albert Patterson, San Bernardino, CA (US)

( * ) Notice: Subject to any disclaimer, the term of this patent is extended or adjusted under 35 U.S.C. 154(b) by 0 days.

(21) Appl. No.: 14/073,887

(22) Filed: Nov. 7, 2013

Related U.S. Application Data

(60) Provisional application No. 61/724,107, filed on Nov. 8, 2012.

(51) Int. Cl.
*C11D 17/00* (2006.01)
*C11D 3/12* (2006.01)

(52) U.S. Cl.
CPC ..... *C11D 3/1233* (2013.01)
USPC ..... 510/509; 510/488; 510/491

(58) Field of Classification Search
None
See application file for complete search history.

(56) References Cited

U.S. PATENT DOCUMENTS 5,719,112 A * 2/1998 Gordon et al. ..... 510/226
8,119,583 B2 * 2/2012 Day et al. ..... 510/152

* cited by examiner

*Primary Examiner* — Necholus Ogden, Jr.

(57) ABSTRACT

The invention is an environmentally safe surface cleaner with 3 main ingredients and an odor enhancing compound. The ingredients are sodium bicarbonate, triacylglycerol saturated and unsaturated fatty acids, and water. The odor enhancer can be mint or peppermint oil, or almond extract; or it can be excluded from the composition. The invention is effective on multiple surfaces including hard surfaces and fabrics. The 3 main ingredients all have more than one role, rendering the composition as an effective polar solvent and an effective non-polar solvent. The composition is used in conjunction with a hard plastic scraper or soft cloth or other physical scouring device with a harness of no more than 2.5 on Moh's hardness scale. The composition is an effective scouring agent that aids in breaking the bonds between atoms of the surface debris and atoms of the surface.

17 Claims, No Drawings

SURFACE CLEANING COMPOSTION OF COLLOIDAL ALKALI CARBONATES SUSPENDED IN FATTY ACIDS

CROSS-REFERENCE TO RELATED APPLICATIONS

This application claims the benefit of U.S. Provisional Application No. 61,724,107, filed on Nov. 8, 20012, the disclosure of which is incorporated herein by reference.

STATEMENT REGARDING FEDERALLY SPONSORED RESEARCH (Not Applicable)

BACKGROUND OF THE INVENTION

A composition with a formulation, based on a mass rationale for mixing ratios of 3 ingredients, is determined in addition to one or more ingredients for enhanced odor appeal; the composition is a non-sudsing surface cleaner. The composition requires no further chemical synthesis from the raw material components comprising the mixture. The inspiration for this invention came from the necessity to clean the stove top surface of the inventor's kitchen stove top. The stove top is a common stove top, with a metal surface coated with a white ceramic glaze. Inevitably, the surface would end up with rather stubborn stains and cooked on debris that would not easily come off using oven and stove cleaners available on the market or detergent cleaning agents available on the market. At the behest of using a metal knife for physically scraping off the soiled debris, with the risk of scratching the surface, the inventor used his background and knowledge as a chemistry teacher to develop and formulate a composition that would be effective in removing debris and cooked on soil from the stove top, while at the same time be safe for the environment and the user. Over time, the composition has been expanded to use on other surfaces including different metals, granite, glass, plastics, cloth, leather, wood, and surfaces made of polymers such as linoleum floors and vinyl surfaces. Types of stains and chemicals that the composition was successful and effective in removing were tested and determined to be baked on food, transition metal ions, ink, gum, glue and other adhesives, grease, oil, and tar.

This composition has been tested on several surfaces and stains. It has been tested as a grease spot remover on a pair of blue denim jeans that had a stubborn grease stain embedded into the fabric for more than a year. The jeans with the grease stain embedded in them had been worn and washed with laundry detergent multiple times, and the grease stain persisted. This surface cleaning compound was rigorously rubbed over the grease stain with a hard rubber scraper. The grease stain was completely removed from the denim jeans. This composition was also tested on the floor of a shower that had a blue stain from dripping water onto the shower floor. The floor is composed of a solid white acrylic polymer. The stain was successfully removed from the surface by wiping over the stain with the composition, using a soft cloth. Another test was performed of how the composition works on skin, where by oil and grease from changing the oil and oil filter in a car resulted in very oily and greasy hands. The composition successfully cleaned all the oil and grease off the hands, working much better than washing the hands with detergent and warm water. When this composition was tested on permanent ink, written on a plastic sandwich bag, it effectively removed the permanent ink from the surface of the bag.

A spectacular example of the capability of this composition was demonstrated on removing gum from a cotton jacket. The composition was 100 percent effective in removing gum from the cotton fabric of a jacket. The gum was completely stuck and integrated into the threads of the fabric for over a week, after it was worn for an entire evening after being discovered that the gum was on the jacket. This use was discovered much after the provisional patent was filed; the point being, that more uses for this composition are being discovered as the need arises.

This invention is a composition of matter that can be used as a dual action surface cleaner, in general, for hard surfaces comprised of metal, plastic, wood, glass, granite, marble, concrete and various man made hard surfaces composed of polymers, as well as soft surfaces in cloth, fabric, clothing, leather, and man made fabrics. The invention also is effective as a skin surface cleaner for cleaning the head, including hair, as well as other areas of skin, such as the torso, hands, arms, feet, legs, fingers and toes, utilizing the same dual action. The composition contains ingredients all used for human consumption, so it is safe to use on the skin and safe for the environment.

The first aspect of the dual action involves the breaking of chemical bonds between surface molecules and the chemical soiling agent molecules or chemical residues via chemical activity of the composition, in conjunction with scouring activity and the mechanical action of firm rubbing with a soft cloth or hard rubber scraper, or other physical scouring device with a hardness of no greater than 2.5 on Moh's hardness scale. The second aspect of the dual action involves the action as a solvent on the surface stain or soiled residue compound. Because the proposed composition in this patent application has ionic species of alkali metal cations, hydronium cations, hydroxide anions and carbonate anions in water, it is an effective polar solvent. It also has an excess of sodium bicarbonate crystals mixed in monounsaturated and saturated hydrocarbons, as fatty acid triacylglycerols, suspended in water, rendering it an effective non-polar solvent. This composition in this application will remove water soluble residue or chemical components from a surface and also the composition has non-polar chemical components in the fatty acid hydrocarbon chain that render it as an effective solvent for fats, oils, permanent ink types, and many other chemicals that are not water soluble. The composition is effective in breaking chemical bonds of surface residue chemical components because there are several chemical species within the composition that have areas of polarity. These strong polar regions can be used to act upon different molecular and ionic surface stains. Such chemically active species within the composition are carboxylic acid, carbon-carbon double bonds and carbon-oxygen double, within the unsaturated fatty acid hydrocarbons as triacylglycerols, in addition to dissolved ions, including hydronium, sodium, carbonate, and hydroxide ions. It is a combination of these constituents that give the composition its properties and that makes it unique, and useful, and non-obvious or somewhat reclusive in the cognitive domain of human thought. It is counter intuitive to consider a composition with triacylglycerol fatty acids and water as a solvent; however the effect of combining it with sodium bicarbonate allows the fatty acids and water mixture to emulsify and integrate largely as a suspended colloidal phase with dual properties.

Evidence that the composition is not solely acting as a solvent exists in a simple test. If the composition is applied over the areas of a surface stain or surface residue that is desired to be removed, and allowed to set for several minutes to hours, there is no effective removal of the surface contaminant. Many times there is no noticeable effect in allowing the composition to be applied for an appropriate amount of time (minutes to hours) as to the removal of the surface contaminant.

Residue of burned on fats, carbohydrates, proteins, and other organic compounds such as glues, inks, dyes, oil and grease and inorganic soiling agents, such as stains from iodine or oxidized transition metal ions, or inorganic inks and dyes often get incorporated into the surfaces on metal and glass cooking ware, stove top surfaces, counter tops in the kitchen and bathrooms, wood floors, carpet, leather, vinyl, fabric, and other surfaces in general. Patents for cleaning compositions, each have their own unique uses and methods of cleaning surfaces with these aforementioned residues, rely on various chemicals such as the use of detergents, organic solvents, or compounds containing chemicals that alter pH or oxidation states, and in effect, remove the residue or soil in combination with the use of a scouring pad or other mechanical forced removal. When scouring pads such as steel wool or other substances that are composed of a material with greater hardness than the surface being cleaned, this can result in the undesirable effect of the surface being scratched up or marred. Often times the surface cleaners on the market today can be volatile or flammable, or they can be too reactive to be considered safe to use without protection of rubber gloves or aprons. Also many surface cleaners on the market can chemically damage some surfaces such as volatile organic polar solvents often dissolve plastic surfaces, and so they cannot be used on such surfaces. In addition, some surface cleaners on the market today leave behind an indelible mark, or discoloration on certain surfaces, and are only designed to clean a limited type of surface. Often times the directions for use of cleaning compositions will specifically detail what types of surfaces and what types of stain they are to be used on or not used on. They also mention the precautions and hazards associated with using the product.

Typical cleaning compositions are shown, for example, in the following United States of America patents:

U.S. Pat. No. 4,051,056 Hartman
U.S. Pat. No. 4,240,919 Chapman
U.S. Pat. No. 4,676,920 Culshaw
U.S. Pat. No. 6,268,325 Luciani et al.
U.S. Pat. No. 6,537,957 Cardola et al.
U.S. Pat. No. 6,767,878 Paye et al.

Because sodium bicarbonate, which has a hardness of 2.5 on Moh's hardness scale, is the solid component of the scouring agent in this composition, surfaces harder than this will not be scratched or marred when this composition is applied as a cleaning agent to clean and remove stains from the surface. Furthermore the water and fatty acid triacylglycerols mixed in with the sodium bicarbonate do not have the chemical properties of damaging most surfaces. In conclusion, this composition is useful, on many diverse surfaces and on many diverse polar and non polar surface stains.

Often the material residues or stains that soil a surface, are chemically attached to a surface in general; and they have varying chemical bonding properties with their surface and varying solubility properties with the cleaning agent used to remove them. A combination of these bonding and solubility properties enable residue and chemical soils to attachment to the surface and effectively inhibit their removal by methods dependent on the chemical properties of the chemical cleaning agent, especially if the properties of the residue oppose the properties of the chemical cleaning agent. For instance, the use of a water soluble cleaning agent in the use of removing a non-water soluble compound would result in generally undesirable effectiveness; the opposite would generally be true as well. In other words, a cleaning composition that is not water soluble would generally be ineffective in removing stains or residue that are water soluble.

The appropriate use of this composition for cleaning the aforementioned surfaces, with the aforementioned residues or chemical soiling agents, is an effective method of removing the soiled chemical residues from the surfaces. The action of the composition is two-fold, first by acting as a medium for use as physical scouring, without scratching any surfaces of greater than 2.5 hardness rating on Moh's hardness scale, and second, as a polar and non polar agent that will assist in dissolving and transporting the residue away from the surface in which it is incorporated as a stain. The composition, when used as a scouring agent, accompanying mechanical scouring with a soft cloth or hard rubber scraper, is effective in breaking surface bonds between the chemical residue or stain with the surface in which it is incorporated. The composition is then equipped to dissolve and carry away the constituent stain particles so that they can be wiped off with a cloth. As well, the composition when applied as a pretreatment, is effective in dissolving certain stains and residues from compounds that are weakly held to the surface and contain polar or non-polar molecules that can be dissolved or softened by the composition.

The dual action of the composition as a scouring medium, efficient in breaking bonds of surface residues and chemical soils from surfaces, and as a polar (water soluble) and non polar (fat soluble) solvent is also effective in removing gum, ink, oil, grease, and transition metal stains such as iron from soft cloth surfaces such as cotton, leather and vinyl.

The surface cleaning composition proposed for general use in this patent application contains a mass ratio of sodium hydrogen carbonate with a mass ratio of water and hydrocarbons, specifically, fatty acids as triacylglycerols. For purposes of maintaining a composition that more closely approximates a colloidal suspension, with minimal settling of the mixture components, the mass ratio for general use has been determined to be 70.5% sodium hydrogen carbonate, 17.3% fatty acids and 12.2% water.

This composition different from other surface cleaners in that this surface cleaning composition does not incorporate organic solvents, other than saturated and unsaturated fatty acids, where as other cleaning compositions contain alcohols, alkanes, amines, betaines, oxides, paraffins and other waxes. The surface cleaning composition in this application also does not incorporate bleaching agents. It also relies on sodium bicarbonate as its scouring agent as opposed to other compositions which use on or more salts of acetates, oxides, phosphates, sulfates, and sulfonates, and various mineral clays, silica, diatomaceous earth, feldspar, perlite, pumice, vermiculite, and mixtures thereof. In addition, the sodium bicarbonate in this surface cleaning composition has a dual use as a medium to assist in emulsifying the triacylglycerol fatty acids in a small amount of water; the sodium bicarbonate is also used as a medium to aid in the mechanical scouring of surface residue and chemical soils, without scratching the surfaces harder than 2.5, on Moh's hardness scale.

SUMMARY OF THE INVENTION

The present invention is a surface cleaning composition, that can be described as a viscous paste that will undergo partial settling upon standing; but will mix when rigorously shaken. The composition includes a super saturated solution of sodium bicarbonate, with a very large excess of sodium bicarbonate in the undissolved state, mixed in with saturated and unsaturated hydrocarbons in the form of fatty acids, mainly incorporated as triacylglycerols. The fatty acid triacylglycerol components become emulsified in the super saturated solution of sodium bicarbonate and undissolved sodium bicarbonate. The end result is a colloidal suspension.

The composition is effective as a scouring agent and hand cleaner for grease, oil, tar, ink, dyes, grime, gum remover, and general use surface cleaner on hard surfaces. In the case of a scouring agent, when the composition is mechanically and rigorously rubbed into the surface with a hard rubber scraper or soft cloth, or other physical scouring device of hardness less than 2.5 on Moh's harness scale, it breaks bonds between the surface atoms being treated and surface atoms comprising the surface residues. In addition, the composition helps dissolve both polar and non-polar molecules in the chemical components of the surface stain. The mechanical wiping and scraping with a soft cloth or hard rubber spatula or other physical scouring device, with a hardness no greater than 2.5 on Moh's hardness scale, creates a frictional force over the surface, where the stain is embedded. It is this frictional force that allows the chemically reactive double bonds at unsaturated carbon locations, and the double bonded oxygen atoms in the fatty acid heads, and the edges of the crystal lattice sodium and carbonate ions to physically be pushed close enough to the electron clouds of the atoms in the organic and inorganic molecular or ionic stains, and cause the bonds or attractions of these stains to be broken with the surface of which they are embedded.

There are several advantages of the composition in this application. The composition of the stain remover can then carry away both polar and non-polar molecules that have been removed from the surface. After removing a stain, some stain removers may themselves harm the surface by bleaching or discoloring or leaving behind a surface alteration. For instance, some stain removers contain volatile organic solvents and would damage fabric of nylon and polyester or surfaces made of plastic. This composition can be used on many more types of surfaces without damaging them. An exception to this is use on polished aluminum. It will remove the polish on the aluminum, rendering the surface of the aluminum bare of its protection that the polish provided. It is a non-flammable, non-volatile, environmentally safe composition, being made of all chemical constituents that are ingested by humans and not disapproved by the FDA or EPA. One concern about sodium bicarbonate with the FDA, is that it has been assigned a level C rating for it cannot be ruled out to be a health concern for pregnant women; however that concern relates to using sodium bicarbonate as an antacid in pregnant women. There have been concerns that using sodium carbonate as an antacid in people taking certain medications may also pose a health concern. In both these cases, the health concern arises over ingesting the sodium bicarbonate. This surface cleaner is not intended to be used as something to ingest, so that is rationale for the claiming this composition an environmentally safe composition.

Other surface cleaners may be effective in removing water soluble residues and surface stains such as water based glues or inks or stains; however not so effective on removing water insoluble residues or stains from permanent inks, grease, oil, tar, gum, and other water insoluble surface residue matter. This composition is effective on multiple combinations of water soluble and water insoluble surface stains and residues. After rigorous mechanical wiping, the surface cleaner and its removed surface soil and residue can be removed from the cleaned surface with a soft cloth. Any amount of the liquid surface cleaning left behind, can be washed away warm water. Because of the absence of abrasives and harmful or caustic chemicals, this chemical composition, has an advantage over many surface cleaners that rely on hard abrasives that scratch the surfaces or caustic chemicals that are hazardous to the environment and hazardous to the user. Also this composition is an effective hard surface cleaner, as well a an effective fabric cleaner and hand or foot cleaner. In the case of use on fabric, after the stain is removed, the fabric should be washed in a washer with detergent and warm water.

DRAWINGS (Not Applicable)

DETAILED DESCRIPTION

The ratio of ingredients, for general use formulation, on surface stains with both polar and non polar constituents, is 70.5% by mass of sodium bicarbonate, 17.3% by mass of fatty acid hydrocarbons (as triacylglycerols, with about 0.5% free fatty acids), and 12.2% by mass of water. The fatty acids are supplied from olive and canola oils as triacylglycerols. The range in composition from 9% to 14% saturated fatty acids such as stearic acid and palmitic acid and 86% to 91% unsaturated fatty acids such as oleic and linoleic acids.

The composition can be tailored in several formulations, depending on intent or purpose, regarding what types of surfaces are intended to be used on and what types of stains or soiling agents are on those surfaces. For example, if the intent is to be used as a hand cleaner for grease and oil, then the formulation will contain a lower percentage of water and unsaturated fatty acids a slightly larger percentage of saturated fatty mixed with a specific ratio of sodium bicarbonate. An added agent such as peppermint oil almond extract is added for enhanced odor. If the purpose is for use as a stove surface cleaner, then a higher degree of unsaturated fatty acids is incorporated into a mass of sodium bicarbonate incorporated and mixed with a mass of fatty acid triacylglycerols and a small amount of water with a negligible amount of the odor enhancer. The formulations all contain fatty acids as triacylglycerols and sodium carbonate as the major components; they differ in the amounts of water. In the next few paragraphs, the specific percentage by mass of different formulations, for different purposes is written in detail.

Specifications for preparing a composition of the surface cleaner that can be used on stove top surfaces or metal and glass cookware, that have baked on caramelized debris stuck to the surface, have been determined to function ideally with a mixture of 38% fatty acid, 60% sodium bicarbonate and 2% mass of deionized water. The percentages were easily arrived at; when the estimated ratios were mixed at room temperature, and allowed to settle, the amount of excess liquid was decanted and the final constituents were calculated on a percent mass basis. In the stove surface cleaner, the fatty acid chains contain more unsaturated hydrocarbons than saturated. Ideally, the fatty acid hydrocarbons that are in olive oil can be used for a source of the ratio of unsaturated hydrocarbons to saturated hydrocarbons. Any oil that contains a larger percentage of unsaturated hydrocarbons (85% to 93%) will suffice. It is the double bonded unsaturated carbon that provides a greater chemical activity for breaking bonds between surface stain molecules and the metal or semi-metal atoms of the stove top or glass surface. The composition is prepared by mixing the sodium bicarbonate, and fatty acids found in olive oil or canola oil, together with deionized water, in the prescribed ratio, and stirring them together rigorously until a uniform and creamy composition is obtained. For surface cleaning, the composition is applied over the surface that is intend to be cleaned and then a soft cloth or hard rubber scraper is used to rigorously rub over the soiled matter on the surface until it becomes unbound to the surface. The composition will turn brown from the color of the caramelized matter that was once bound to the surface. The composition can then be wiped away with a soft cloth leaving the surface shiny and free from surface caramelized particles. If desired, the surface can be washed with warm water and a mild detergent.

Specifications for preparing a composition of the surface cleaner that can be used as a hand cleaner for grease and oil and grime, have been determined to function ideally with a percent mass ratio of 3% to 6% water mixed with 31% to 37% fatty acid and 57% to 66% sodium bicarbonate. The fatty acid hydrocarbons contain 12% to 13% saturated fatty acids such as palmitic and stearic acids and 87% to 88% unsaturated fatty acids such as oleic and linoelic acids incorporated into triacylglycerols. In this case, the composition utilizes the property of being a non-polar solvent of fatty acids mixed with a saturated solution of sodium bicarbonate, and a substrate of solid sodium bicarbonate, to help scrub off and sequester the grease, oil, and grime and carry it away from the skin. The composition is prepared by simply mixing the sodium bicarbonate and fatty acid triacylglycerols found in corn oil together in the said ratio. The composition is liberally applied to the hands and rubbed into the hands by sliding the hands and rubbing them together as one would when they rigorously wash their hands; after all the grease, and oil and grime is removed from the surface of the skin, the composition will be black with grease, oil and grime. It can then be wiped off with a soft cloth or paper towel.

The three chemical constituents of deionized water, sodium bicarbonate, and fatty acids of this composition are important to its function as a surface cleaner. Unsaturated hydrocarbons, in the form of triacylglycerol fatty acids as contain polar regions in the carboxyl group of the first carbon atom of the fatty acid and in the double bond regions of the unsaturated carbon atoms in the hydrocarbon tail of the fatty acid. Also the edges of the sodium bicarbonate crystals contain regions with significant electric fields at the edge sodium ions and the edge carbonate ions. These regions create a means of using the Coulombic forces to break bonds of the surface residue with the surface. In order to push the molecules close enough for the Coulombic forces to become effective, a rubber scraper or soft cloth must be used to push the surface cleaner into the surface being cleaned. This high pressure forcing and scrubbing of the surface cleaner into the surface being cleaned, causes the electron clouds in the molecules of the surface cleaner to be positioned closer to the electron clouds of the ligands that allow the surface chemicals to bond to the surface metal or metalloid atoms; next the bonds between the surface and the surface debris molecules are broken and new bonds are formed with the surface debris molecules and ions present in the surface cleaner. The activation energy that must be overcome to break these bonds, is provided by the work done from the force of sliding friction, produced when scrubbing the compound over the surface, with an amount of pressure, such that the electron clouds can get close enough for Coulomb forces to break bonds of the surface molecules with the surface of which they are attached, and to release the bonded carbon ligand of the stain molecule from the organometallic bond on the surface it of which it is attached.

The released carbon can then be hydrogenated by the action of hydrogen ions present as aqueous hydronium ions provided by the water or fatty acids of the cleaning compound.

Water is an amphoteric substance and this allows the surface cleaner to provide for hydrogen ions (as hydronium ions), and hydroxide ions. These ions are important for the reactions by supplying hydrogen, and hydroxyl groups which are necessary for forming stable bonds after the bonds of the surface debris molecules are broken with the surface metal or metalloid atoms. Also the sodium bicarbonate will dissociate into a sodium cation and a hydrogen cation (as a hydronium ion) and a carbonate anion. These hydrogen ions can also be used to hydrogenate the removed carbon atom from the surface of which it was attached.

Specific chemically active locations within the hydrocarbons of the triacylglycerol fatty acids are double bonds containing sp2 hybridized orbitals. These areas are found at the carbon-carbon double bonds of unsaturated carbons and carbon oxygen double bond of the carboxylic acid, on the first carbon of the fatty acid. It is doubtful that these areas are involved in any chemical reactions at room temperature or at the lower pressure and frictional forces created by scouring and scrubbing with a rubber scraper or soft cloth; however, this may be an area to further investigate, in an expansion of this patent at a later date.

The embodiments of the invention in which I claim exclusive property or privilege are defined as follows:

1. An environmentally safe, non-volatile, non-flammable chemical composition that will not scratch surfaces with a hardness of greater than 2.5 on Moh's hardness scale, for general cleaning of hard surfaces, such as metal, glass, marble, granite, acrylic and other hard surfaces made of polymers, as well as for general cleaning of cloth or fabric surfaces of cotton, polyester, nylon and other fabrics, as well as for use on external surfaces body surfaces of the head (including hair), neck, torso, arms, legs, hands and feet, where as said chemical composition substantially consisting of 57% to 80% sodium bicarbonate by mass, 1% to 12.2% deionized water by mass and 12% to 37% triacylglycerol fatty acids by mass, and an odor enhancement compound such as peppermint oil, mint oil, or almond extract 0% to 0.05% by mass.

2. A chemical composition in claim one, capable of removing organic stains, including, but not limited to blood, grass, oil, grease, gum, glue, dyes, inks, and other organic surface soils and stains, as well as inorganic stains and soils, including, but not limited to iodine, inorganic water soluble inks or dyes, oxidized transition metal stains containing copper, iron, manganese and other transition metal multi-valence oxidized cations, from said surfaces in claim one.

3. A chemical composition in claim one, for cleaning any said surface in claim one, that will leave the surface unaffected and free from scratching, discoloring, or leaving its own indelible markings on the surface, with a successes rate near 99% surfaces tested and may only require a final rinsing with warm water or warm water and a mild detergent after cleaning.

4. The chemical constituent of sodium bicarbonate in claim one is purposeful for general scouring of said surfaces, by providing a physical substrate, with electronegative oxygen atoms in the carbonate ions and electropositive sodium ions and hydrogen ions at the edges of the crystal lattice structure of sodium bicarbonate, whereby said regions provide a Coulombic force to aid in breaking coordinate bonds in surface metal and metalloid ligands and covalent bonds between other surface atoms of molecules of the resident debris when the composition is placed over the surface to be cleaned and firmly scrubbed over the surface with a hard rubber scraper or soft cloth or other physical device or cloth of hardness no greater than 2.5 on Moh's hardness scale.

5. The chemical constituent of sodium bicarbonate in claim one for the purpose of providing hydroxide anion and hydrogen cations (as hydronium ions) to the new covalent bonds formed with carbon atoms of the resident debris molecules, when the carbon breaks its bond with the surface metal atom and said carbon atom is hydrogenated or hydroxylated.

6. The chemical constituent of triacylglycerol fatty acids in claim one for general polishing and shining of said surfaces.

7. The chemical constituent of triacylglycerol fatty acids in claim one, within a range of 12% to 20% saturated fats and 80% to 88% unsaturated fatty acids, to perform the function of providing a non-polar solvent capability of the cleaning composition.

8. The triacylglycerol fatty acids in claim seven above contain positive and negative fields at on the first carbon which is $sp^2$ hybridized with oxygen and these fatty acids serve a second function of assisting the ability of sodium bicarbonate, to break the attractive forces between surface atoms or ions and surface residue atoms or ions, via the mechanism of earlier stated electric fields will ultimately cause Coulombic forces to assist in breaking and overcoming bonds and attractions such as coordinate bonds, covalent bonds and Van der Waals attractions, that will break or be overcome, during the removal of surface debris with the aid of the composition being pressed into the surface and rubbed hard and fast across the surface, with a hard rubber scraper or soft cloth or other physical scraping device or cloth, no harder than 2.5 on Moh's harness scale.

9. The chemical constituent of deionized water in claim one to provide a means to dissolve the sodium bicarbonate crystals and form a supersaturated solution of sodium bicarbonate.

10. The chemical constituent of deionized water in claim one to preform the function of providing a polar solvent capability of the cleaning composition.

11. The chemical constituent of deionized water in claim one to preform the function of providing a aqueous hydroxide anions and hydronium cations necessary to hydrogenate and hydroxylate the carbon atoms of removed surface debris.

12. The composition of claim one to be altered and adjusted for cleaning hands and skin of grease, grime, oil, and tar, said adjustment being a percent mass ratio of 3% to 6% deionized water, 31% to 37% fatty acid and 57% to 66% sodium bicarbonate.

13. The composition of triacylglycerol fatty acids in claim twelve comprise 12% to 13% saturated fatty acids such as palmitic and stearic acids and 87% to 88% unsaturated fatty acids such as oleic and linoelic acids as a means of removing non-polar residues soiling the skin surfaces on the body.

14. The composition of claim one to be altered and adjusted to a percent mass ratio of 38% fatty acid, 60% sodium bicarbonate and 2% mass of deionized water, for the purpose of cleaning cooked on residue from metal and glass stove tops, metal pans, glass, ceramic and porcelain cookware.

15. The composition of triacylglycerol fatty acids in claim fourteen to comprise 85% to 93% unsaturated fatty acids such as oleic and linoelic acids and 7% to 15% saturated fatty acids such as stearic acid and palmitic acid.

16. The composition of claim one to be altered and adjusted to a percent mass ratio of 80% sodium bicarbonate, 1% water and 19% triacylglycerol fatty acids, for cleaning organic compounds including, but not limited to glue, ink, gum, grease and oil out of cloth fabric, and inorganic compounds including but not limited to oxidized transition metal oxides, and dyes out of fabric, by prescribed scouring technique of placing the composition on the surface of the material to be cleaned, directly over the region of the surface stain, and using a hard rubber scraper or cloth to firmly and quickly rub the composition over the surface of the stain until it is removed.

17. The composition of triacylglycerol fatty acids in claim sixteen comprise 85% to 93% unsaturated fatty acids such as oleic and linoelic acids and 7% to 15% saturated fatty acids such as stearic acid and palmitic acid.

* * * * *